United States Patent [19]

Pontynen

[11] Patent Number: 5,007,764

[45] Date of Patent: Apr. 16, 1991

[54] INSULATED TRAFFICKED SURFACE

[76] Inventor: Esko Pontynen, Vesitorninkatu 9 A 9, 05820 Hyvinkaa 2, Finland

[21] Appl. No.: 435,523

[22] PCT Filed: Mar. 30, 1989

[86] PCT No.: PCT/FI89/00059

§ 371 Date: Jan. 24, 1990

§ 102(e) Date: Jan. 24, 1990

[87] PCT Pub. No.: WO89/09853

PCT Pub. Date: Oct. 19, 1989

[51] Int. Cl.[5] ..... E01C 3/06

[52] U.S. Cl. ..... 404/70; 404/28; 404/31

[58] Field of Search ..... 404/27–31, 404/34–36, 70–72; 14/2.6, 27

[56] References Cited

U.S. PATENT DOCUMENTS

| | | | |
|---|---|---|---|
| 1,791,840 | 2/1931 | Pöpke | 404/70 |
| 2,358,023 | 9/1944 | Munters | 404/31 |
| 3,722,378 | 3/1973 | Best | 404/31 |
| 3,804,543 | 4/1974 | Best | 404/28 |
| 4,487,151 | 12/1984 | Deiana | 14/2.6 X |
| 4,488,833 | 12/1984 | Perry et al. | 404/35 |
| 4,621,385 | 11/1986 | Gillois | 14/2.6 X |

FOREIGN PATENT DOCUMENTS

| | | |
|---|---|---|
| 2636983 | 12/1985 | Fed. Rep. of Germany . |
| 45716 | 10/1928 | Norway . |
| 447280 | 11/1986 | Sweden . |

OTHER PUBLICATIONS

Insinööriuutiset No. 105, issued Nov. 14, 1986, "Rautaruukki Kokeilee Peltiä tie ersisteenä", p. 3

*Primary Examiner*—Ramon S. Britts
*Assistant Examiner*—Gay Ann Spahn
*Attorney, Agent, or Firm*—Harrison & Egbert

[57] ABSTRACT

An insulated trafficked surface having a first sheet of steel having corrugations, a second sheet of steel having corrugations attached perpendicular to and adjacent to the first sheet, a plurality of fasteners connecting the second sheet to the top of the first sheet, a heat insulating fill material filling the cavities of the corrugations of the first and second sheet, a covering layer of aggregate material formed on the top surface of the first and second sheets, and a surface layer of pavement formed over the top surface of the covering layer. The fasteners may be either rivets or screws. the aggregate material is a stabilized or unstabilized crushed aggregate. The surface layer is an asphalt pavement. The fill material is an expanded plastic.

8 Claims, 1 Drawing Sheet

INSULATED TRAFFICKED SURFACE

TECHNICAL FIELD

The present invention relates to trafficked surfaces, such as paved or unpaved roadways, airport runways, walkways, railroad foundations, and the like.

BACKGROUND ART

Roads, railroads and airports have traditionally been constructed on foundations of earth and rock without heat insulation. Such foundations are, to a greater o lesser degree, susceptible to frost damage such as heaving and surface cracking. In addition, roads are commonly built with insufficient carrying capacity leading to washboarding and damage to the road surface.

SUMMARY OF THE INVENTION

By riveting or screwing sheets of corrugated steel crosswise one on top of the other and filling the cavities between the corrugations with insulating material (polystyrene, peat) a grillage foundation can be built for use in road, railroad and airport construction with both load-bearing and insulation properties. In road and airport construction this insulated steel foundation would be topped by a layer of crushed aggregate or chips stabilised, if required, with cement and then graded. A surface layer or asphalt or concrete pavement could then be applied.

The advantages of such an insulated steel load-bearing grillage foundation in road, railroad and airport building are that the desired load-bearing and insulation properties can be achieved on top of cheap, locally-obtainable, frost-susceptible materials such as boulder clay. In addition, in road and airport building the load-bearing and insulation properties of this grillage foundation permit the use of a thin layer of unreinforced concrete pavement, generally considered superior to asphalt in durability, to be applied as the surface layer. In railroad construction the tracks can be fixed directly to the top layer of corrugated steel. The insulated steel foundation can also be incorporated into existing roads, railroads and airports thereby taking advantage of their existing structural components and, at the same time, both suplementing their carrying capacity and insulating them.

The use of expanded plastic elements to fill the cavities between the corrugations in the steel sheets comprising the heat-insulated steel grillage will result in a structure capable of floating on water with a load-bearing capacity and rigidity determined according to need. Such a structure, with a covering of asphalt or steel plate, may be used on lakes or swamps as the foundation for a floating airstrip for military use in times of emergency or, under normal conditions, for light aircraft. Similarly, the structure can be used to build an emergency floating platform over waterways. The structure can also be fitted with an outboard motor for use as an emergency ferry and, under normal conditions, can serve as a pontoon jetty which can speedily be turned into an emergency ferry. in all the above-mentioned uses the structure permits of rapid assembly from easily stored and portable sections.

DESCRIPTION OF THE PREFERRED EMBODIMENT

Figure 1:
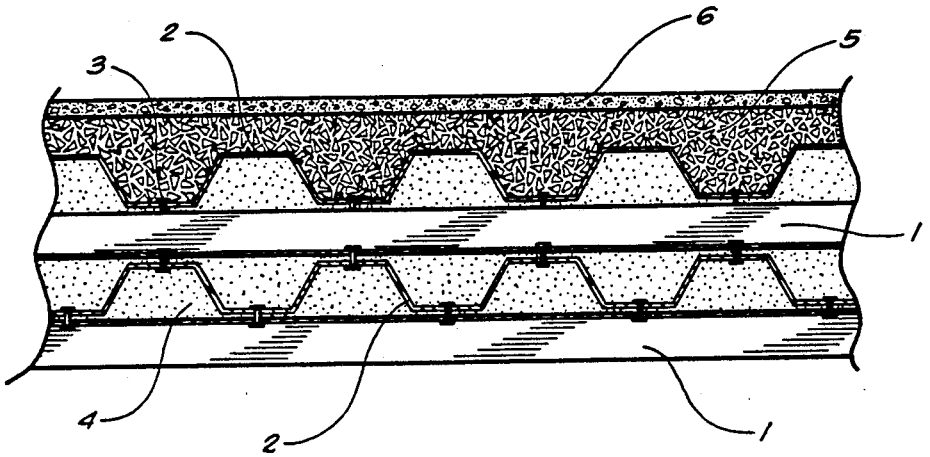
FIG. 1 is a cross-sectional view of the preferred embodiment of the present invention.
Figure 2:
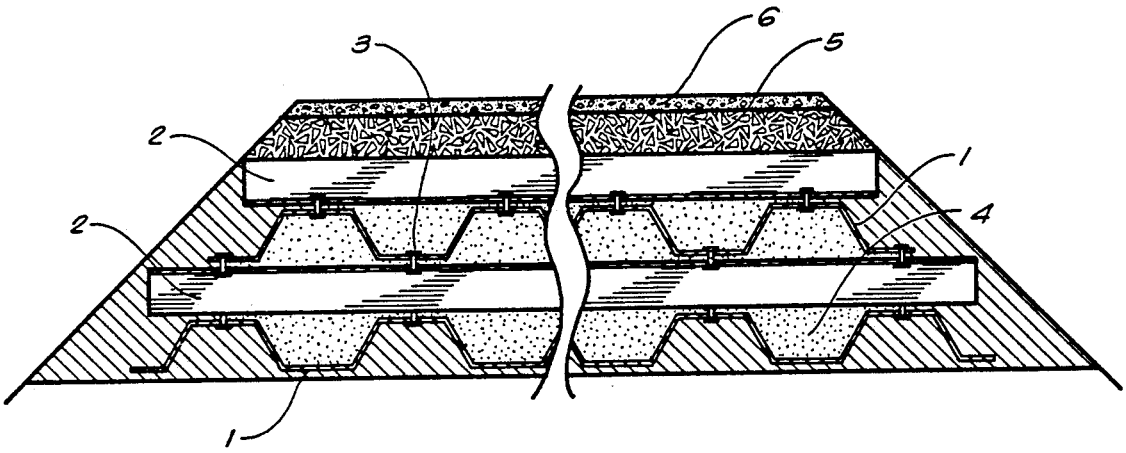
FIG. 2 is a cross-sectional view taken across line A—A of FIG. 1 of the preferred embodiment of the present invention.

The diagram overleaf illustrates the structure as it might be used in road and airport construction. Sheets of corrugated steel positioned logitudinally (1) are fixed ast right-angles to similar sheets of corrugated steel positioned cross-wise (2) by means of rivets or screws (3) thus forming the grillage structure. The cavities between the corrugations are filled with insulating material (4) such as expanded plastic or peat. This grillage foundation is then covered in a layer of stabilised or non-stabilised crushed aggregate or chips (5) and surfaced with a layer of asphalt or concrete pavement (6).

I claim:

1. An insulated trafficked surface comprising:

a first sheet of steel having corrugations;

a second sheet of steel having corrugations, said second sheet of steel being attached perpendicular to and overlying said first sheet, each of said first and second sheets having a plurality of cavities formed between corrugations;

a plurality of fastener rigidly affixing said first and second sheets together;

a heat insulating fill material filling said cavities of said first and second sheets;

a covering layer of aggregate material formed on a top surface of said first and second sheets; and a surface layer of pavement formed over a top surface of said covering layer.

2. The insulated trafficked surface of claim 1, said fastener comprising rivets attached to said first and second sheets of steel.

3. The insulated trafficked surface of claim 1, said fasteners comprising screws attached to said first and second sheets of steel.

4. The insulated trafficked surface of claim 1, said layer of aggregate material comprising stabilized crushed aggregate.

5. The insulated trafficked surface of claim 1, said layer of aggregate material comprising unstabilized crushed aggregate.

6. The insulated trafficked surface of claim 1, said surface layer comprising asphalt pavement.

7. The trafficked surface of claim 1, said surface layer comprising concrete pavement.

8. The trafficked surface of claim 1, said heat-insulating fill material comprising an expanded plastic material.

* * * * *